US009772165B1

(12) United States Patent
Johnson

(10) Patent No.: US 9,772,165 B1
(45) Date of Patent: Sep. 26, 2017

(54) DUAL BOW SIGHTING APPARATUS

(71) Applicant: Ernest Scott Johnson, Hawthorne, FL (US)

(72) Inventor: Ernest Scott Johnson, Hawthorne, FL (US)

( * ) Notice: Subject to any disclaimer, the term of this patent is extended or adjusted under 35 U.S.C. 154(b) by 0 days.

(21) Appl. No.: 15/408,939

(22) Filed: Jan. 18, 2017

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 124/87; 33/265
See application file for complete search history.

(56) References Cited

U.S. PATENT DOCUMENTS 3,013,336 A * 12/1961 Pennington ..... F41G 1/467 33/265
4,120,096 A * 10/1978 Keller ..... F41G 1/467 33/265
4,368,581 A * 1/1983 Tullos ..... F41G 1/467 33/265
4,535,544 A * 8/1985 Jones ..... F41G 1/345 33/265
4,580,349 A * 4/1986 Webb ..... F41G 1/467 33/265
4,711,036 A * 12/1987 Morris ..... F41G 1/467 33/265
4,796,364 A * 1/1989 Amacker ..... F41G 1/467 33/265
4,884,347 A * 12/1989 Larson ..... F41G 1/467 124/87
4,974,328 A * 12/1990 Lowry ..... F41G 1/467 124/87
5,121,547 A * 6/1992 Littlejohn ..... F41G 1/467 33/265
5,220,907 A * 6/1993 Lonsdale ..... F41G 1/467 124/87
5,253,423 A * 10/1993 Sullivan, Jr. ..... F41G 1/467 124/87
5,454,169 A * 10/1995 Keller ..... F41G 1/467 124/87
5,561,910 A * 10/1996 Maynard ..... F41G 1/467 124/87
5,651,185 A * 7/1997 Vanderheyden ..... F41G 1/467 124/87
6,079,111 A * 6/2000 Williams ..... F41G 1/467 124/87

(Continued)

*Primary Examiner* — Alexander Niconovich
(74) *Attorney, Agent, or Firm* — Dale J. Ream

(57) ABSTRACT

A dual bow sighting apparatus includes a mounting member configured for attachment to the archery bow. An upper sight assembly is coupled to an upper end of the mounting member at a predetermined vertical elevation, the upper sight assembly having an upper frame section and a pendulum sight pivotally coupled to the upper frame section. A lower sight assembly is coupled to a lower end of the mounting member and positioned at a vertically adjustable elevation relative to the upper sighting assembly, the lower sight assembly having a lower frame section and a vertical sight pin extending upwardly from the lower frame section. An elevation adjustment assembly is coupled to the mounting member and having a linkage in communication with the lower sight assembly such that actuation of the linkage by a user changes a vertical distance between the upper and lower sight assemblies, respectively.

20 Claims, 7 Drawing Sheets

(56) References Cited

U.S. PATENT DOCUMENTS

| | | | | | |
|---|---|---|---|---|---|
| 6,094,829 | A * | 8/2000 | Koestler, III | F41G 1/467 | 124/87 |
| 6,145,208 | A * | 11/2000 | Savage | F41G 1/467 | 124/87 |
| 6,430,821 | B1 * | 8/2002 | Cionni | F41G 1/467 | 124/87 |
| 6,539,637 | B1 * | 4/2003 | Hollabaugh | F41G 1/467 | 124/87 |
| 6,601,308 | B2 * | 8/2003 | Khoshnood | F41G 1/467 | 124/87 |
| 6,796,039 | B2 * | 9/2004 | Walbrink | F41G 1/467 | 124/87 |
| 6,964,105 | B2 * | 11/2005 | McLeod | F41G 1/467 | 124/87 |
| 7,000,327 | B2 * | 2/2006 | Rager | F41G 1/467 | 124/87 |
| 7,200,944 | B2 * | 4/2007 | Rager | F41G 1/467 | 124/87 |
| 7,243,432 | B1 * | 7/2007 | Rager | F41G 1/467 | 124/87 |
| 7,412,771 | B2 * | 8/2008 | Bradley | F41G 1/467 | 124/87 |
| 7,581,325 | B1 * | 9/2009 | Willman | F41G 1/467 | 124/87 |
| 2008/0282560 | A1 * | 11/2008 | Bradley | F41G 1/467 | 33/265 |

* cited by examiner

DUAL BOW SIGHTING APPARATUS

BACKGROUND OF THE INVENTION

This invention relates generally to bow sighting devices and, more particularly, to a dual bow sighting apparatus having one fixed position sight assembly and a second sight assembly that is vertically adjustable relative to a distance from the fixed bow sight assembly. The fixed position sight assembly includes a pendulum and is preset and appropriate for taking short range arrow shots whereas the adjustable bow sight may be adjusted to an elevation corresponding to a longer range shot prior to making the shot.

Various pendulum style bow sight devices have been proposed in the art for more accurately aiming an archery bow in circumstances where the bow get tilted forwardly, rearwardly, or it simply is not maintained in a completely level orientation when aiming for a shot. Further, various sighting pins have been proposed for making it easier for a hunter to fixate on the target prior to taking a shot with a bow and arrow.

Although presumably effective for their intended purposes, the existing devices do not prepare a hunter for having to take a longer range shot than the sight was sighted in to make accurately. In other words, the sight assembly is not able to be quickly and easily repositioned or reconfigured in real time while a shot may still be available. In addition, the existing bow sights do not effectively illuminate the sighting pins in low-light situations. Therefore, it would be desirable to have a dual or split bow sighting apparatus having a first fixed position pendulum bow sight assembly that may be sighted for accurate short range shots and having a second adjustable bow site assembly that may be moved up or down relative to the first bow sight assembly so as to account for the elevation needed to sight and take a longer range shot. Further, it would be desirable to have a dual bow sighting apparatus having fiber optic elements configured to absorb ambient light and, as a result, to emit a glowing light for period of time thereafter.

SUMMARY OF THE INVENTION

A dual bow sighting apparatus according to the present invention includes a mounting member configured for attachment to the archery bow. An upper sight assembly is coupled to an upper end of the mounting member at a predetermined vertical elevation, the upper sight assembly having an upper frame section and a pendulum sight pivotally coupled to the upper frame section. A lower sight assembly is coupled to a lower end of the mounting member and positioned at a vertically adjustable elevation relative to the upper sighting assembly, the lower sight assembly having a lower frame section and a vertical sight pin extending upwardly from the lower frame section. An elevation adjustment assembly is coupled to the mounting member and having a linkage in communication with the lower sight assembly such that actuation of the linkage by a user changes a vertical distance between the upper and lower sight assemblies, respectively.

Therefore, a general object of this invention is to provide a dual bow sighting apparatus having upper and lower sight assemblies that enables an operator to more accurately sight a target regardless of distance.

Another object of this invention is to provide a a dual bow sighting apparatus having fiber optic elements configured to absorb ambient light and, as a result, to emit a glowing light for period of time thereafter.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
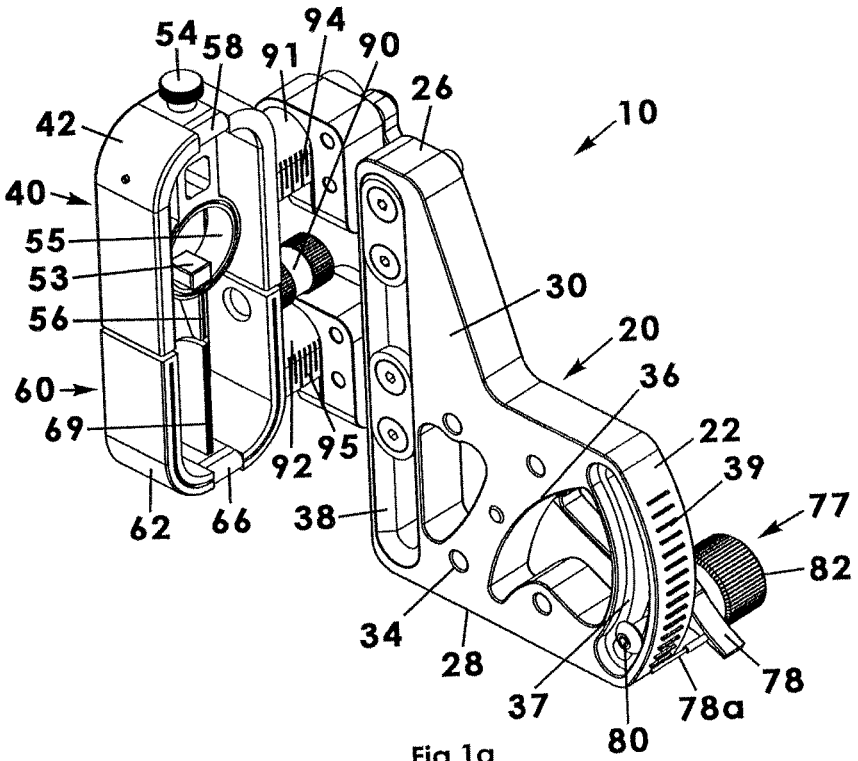
FIG. 1*a* is a front perspective view of a dual bow sighting apparatus according to a preferred embodiment of the present invention.

A dual bow sighting apparatus according to a preferred embodiment of the present invention will now be described in detail with reference to FIGS. 1*a* to 6 of the accompanying drawings. The bow sighting device 10 includes a mounting member 20, an upper sight assembly 40, a lower sight assembly 60, and an elevation adjustment assembly 70.

The bow sighting apparatus 10 includes a mounting member 20 configured for attachment of the apparatus 10 to an archery bow (not shown), also referred to as a compound bow or a hunting bow. The mounting member 20 may also be called a body member as it is the primary structure to which the upper and lower sight assemblies 40, 60 are attached and extend away from. The mounting member 20 may include a front end 22 and an opposed rear end 24, an interior side 30, and an opposed exterior side 32. The mounting member 20 may also define a plurality of spaced apart mounting holes 34 by which the mounting member 20 may be attached to the bow, such as with screws, pins, or other suitable fasteners. In addition, the mounting member 20 may define at least one aperture 36 that enhances the grip of an operator in gripping the mounting member 20, such as with the operator's fingers in the manner of a handle.

Figure 1B:
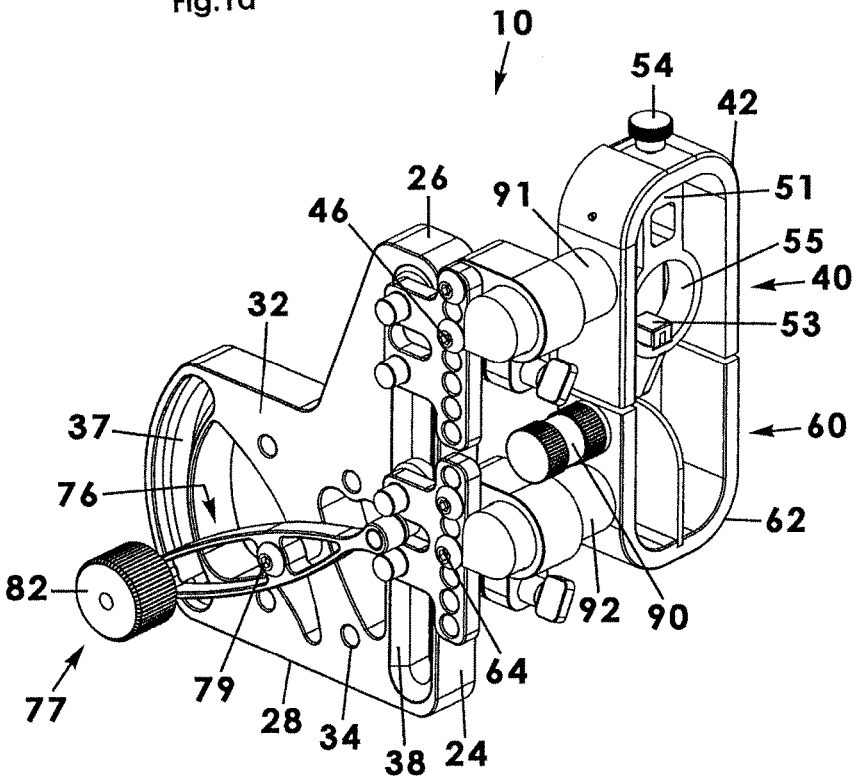
FIG. 1*b* is rear perspective view of the bow sighting apparatus as in FIG. 1.
Figure 2A:
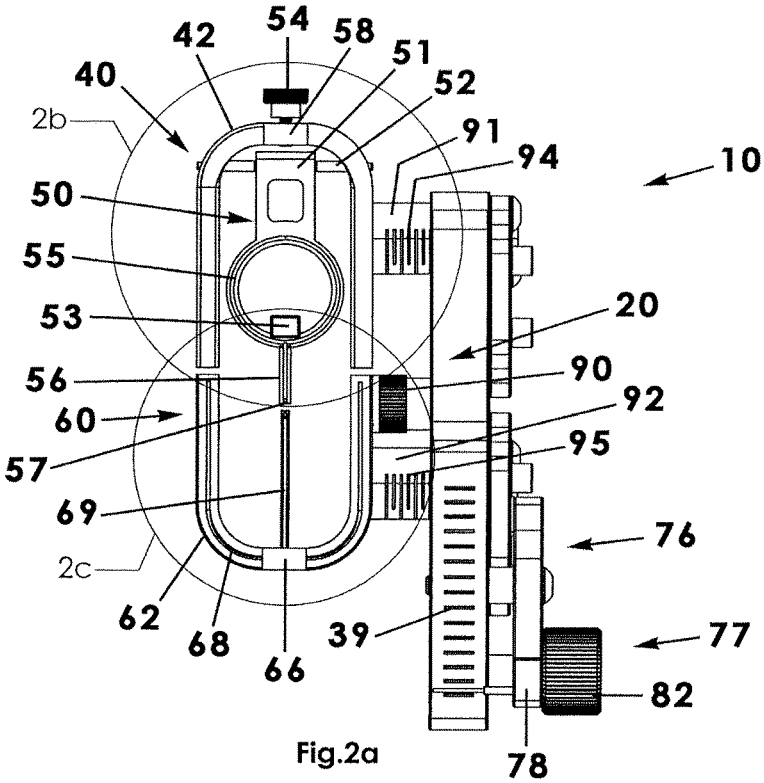
FIG. 2*a* is a front view of the bow sighting apparatus as in FIG. 1.
Figure 2D:
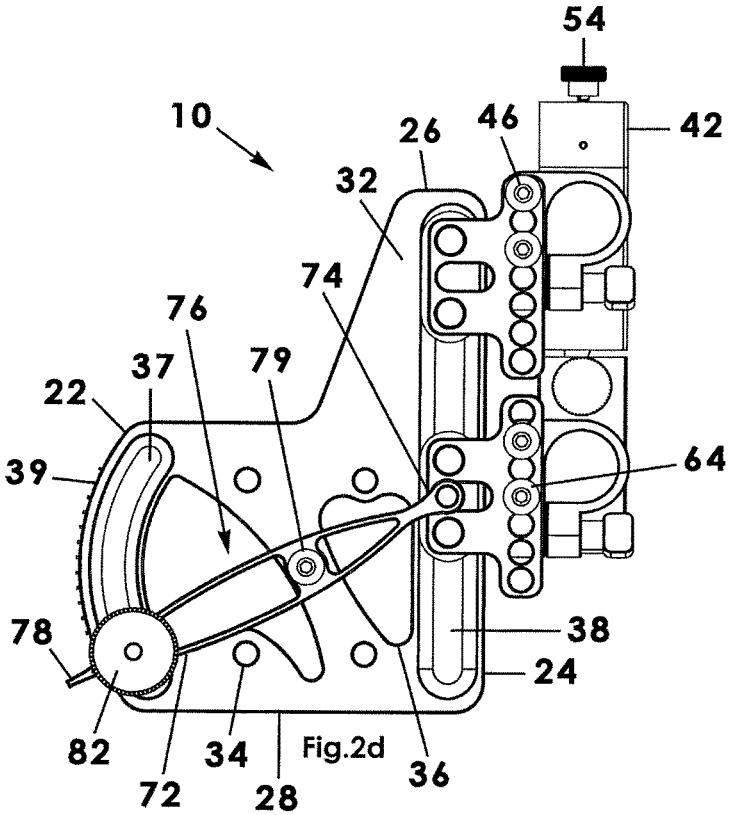
FIG. 2*d* is a side view of the bow sighting apparatus as in FIG. 1.
Figure 2B:
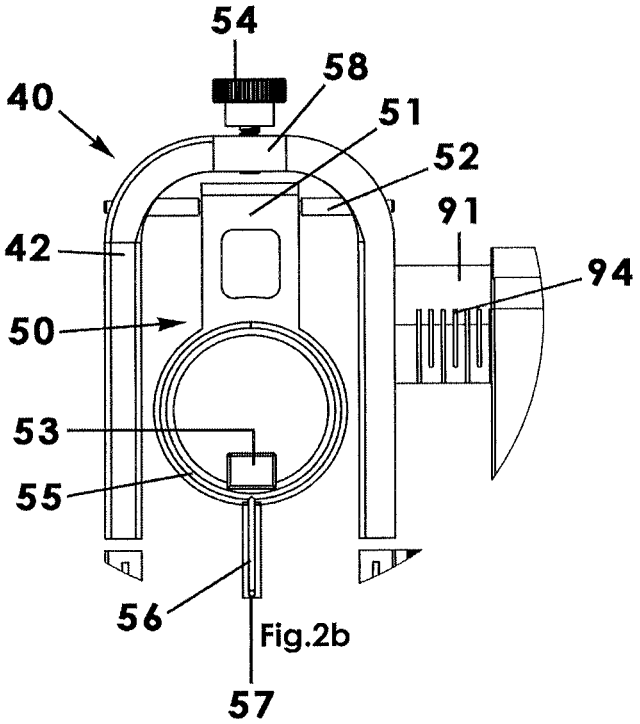
FIG. 2*b* is an isolated view on an enlarged scale taken from FIG. 2*a;*
Figure 2C:
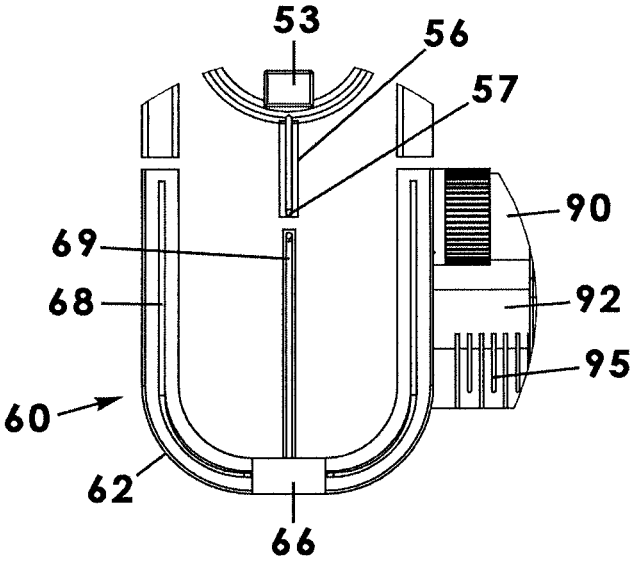
FIG. 2*c* is an isolated view on an enlarged scale taken from FIG. 2*a;*
Figure 3A:
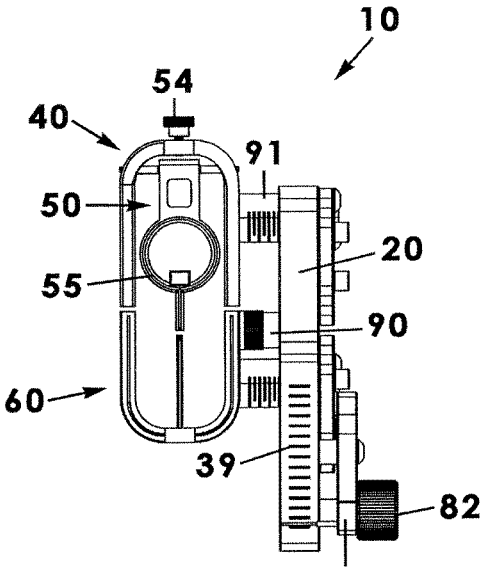
FIG. 3*a* is a front view of the bow sighting apparatus as in FIG. 1 illustrated in a substantially unexpanded configuration.
Figure 3B:
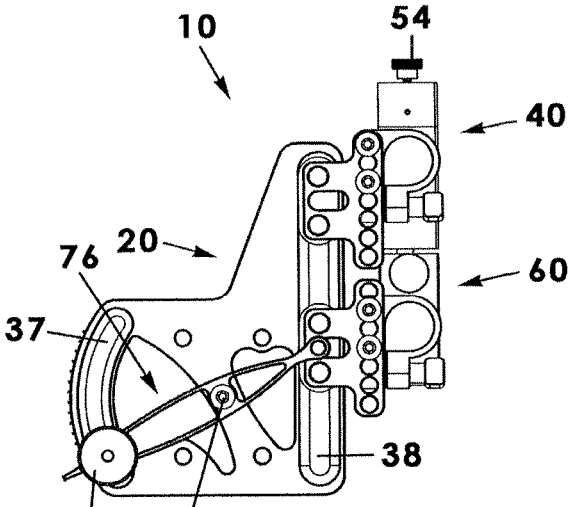
FIG. 3*b* is a side view of the bow sighting apparatus as in FIG. 3*a;*
Figure 3C:
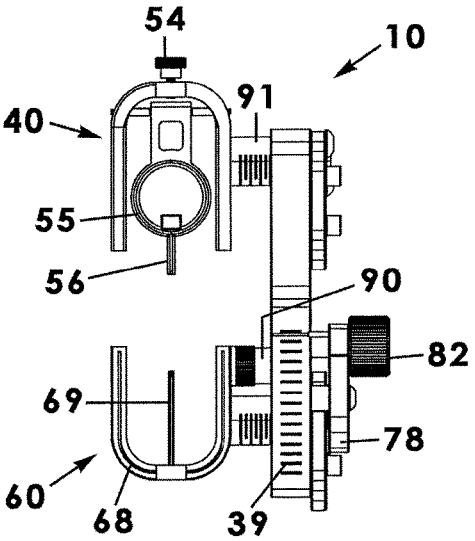
FIG. 3*c* is a front view of the bow sighting apparatus as in FIG. 1 illustrated in a substantially expanded configuration.
Figure 3D:
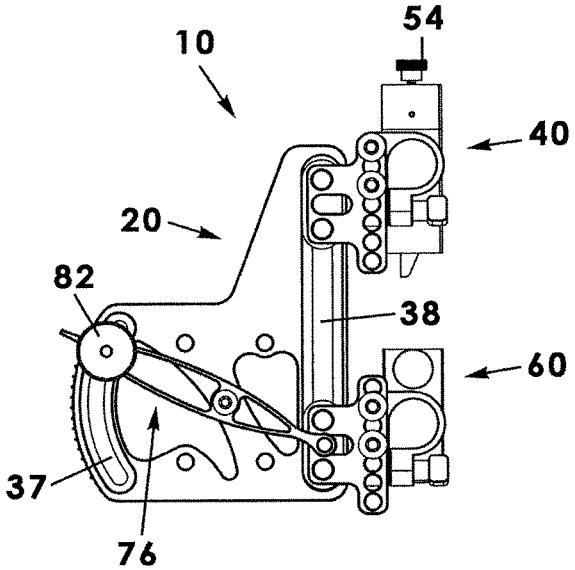
FIG. 3*d* is a side view of the bow sighting apparatus as in FIG. 3*c;*

The upper sight assembly 40 is operatively coupled to the mounting member 20 proximate an upper end 26 and rear end 24 thereof (FIGS. 1*a* and 1*b*). The upper sight assembly 40 includes an upper frame section 42 and a pendulum sight 50 pivotally coupled to a rod 44 situated adjacent an upper end 26 of the upper frame section 42, the pendulum sight 50 being described in more detail later. The upper sight assembly 40 is mounted at a predetermined or fixed elevation position—at least during use of the bow sight apparatus 10. In other words, the upper frame section 42 may include a plurality of upper elevation fasteners 46 that may be set during targeting setup prior to a hunting event but not during hunting.

Similarly, the lower sight assembly 60 is operatively coupled to the mounting member 20 proximate a lower end 28 and rear end 24 thereof. The lower sight assembly 60 includes a lower frame section 62 and includes a vertical sight pin 69 extending upwardly from the lower frame section 62 and will be described further later. Further, the lower sight assembly 60 is initially mounted at a predetermined or fixed elevation position. As described above, the lower frame section 62 may include a plurality of lower elevation fasteners 64 that may be set during targeting setup prior to a hunting event. Unlike the upper sight assembly 40 described above, however, the lower sight assembly 60 is movable upwardly or downwardly during use, e.g. while hunting, by operation of the elevation adjustment assembly 70. It is understood that the lower sight assembly 60 is always separate from the upper sight assembly 40 although the degree and distance of that separation is adjustable via the elevation adjustment assembly 70 described below. Preferably, the mounting member 20 is perpendicular to the upper and lower sight assemblies so that when the mounting member 20 is attached to an archery bow (not shown), the sight assemblies being properly positioned for use as sighting tools for the hunter holding the bow.

In general, the elevation adjustment assembly 70 includes a linkage 76 pivotally coupled to the mounting member 20 and in communication with the lower sight assembly 60, the linkage having a proximal end 72 and opposed distal end 74. Operation of the linkage 76 causes the lower sight assembly 60 to move closer to or further away from the upper sight assembly 40, i.e. to increase or decrease a distance between the two assemblies. The linkage 76 has a linear configuration and is pivotally coupled the exterior side 32 of the mounting member 20 at a fulcrum 78 about midway between opposed proximal 72 and distal 74 ends thereof. The linkage 76 includes an elevation selector lever 78 adjacent the proximal end 72 configured to enable a user to operate the linkage 76. Upward or downward movement of the elevation selector lever 78 by a user causes the lower sight assembly 60 to move in an inverse direction and amount.

A locking assembly 77 is coupled both to the elevation selection lever 78 and to the mounting member and is operable between an actuated (i.e. tightened) configuration that prevents movement of the elevation selection lever 78 and an unactuated (i.e. loosened) configuration allowing movement of the elevation selection lever 78. More particularly, the mounting member 20 defines a first slot 37 adjacent the rear end 24 having a substantially vertical configuration. Correspondingly, the locking assembly 77 may include a first locking fastener 80 in communication with one side of the elevation selection lever 78 and is situated in the first slot 37, the first locking fastener 80 moving upwardly or downwardly in the first slot 37 as the elevation selection lever 78 is moved by a user. Further, the locking assembly 77 may include a second locking fastener 82 in communication with a side of the elevation selection lever 78 opposite the first locking fastener 80 and configured for rotational movement between tightened and loosened configurations preventing or allowing movement of the elevation selection lever 78, respectively. It is understood that the locking fasteners essentially sandwich the lever relative to the mounting member 20. The second locking fastener 82 is illustrated as a rotating knob but may also be a wing nut or other suitable fastener.

Similarly, the mounting member 20 may define a second slot 38—this one situated adjacent a rear end 24 of the mounting member 20 and also having a generally vertical orientation. Frame structures of the lower sight assembly 60 coupled to the distal end 74 of the linkage 76 are positioned to move upwardly and downwardly in the second slot 38 in an inverse direction of movement in the first slot 37.

In a related aspect, an elevation scale 39 is imprinted or adhered to an outer surface of the mounting member 20 proximate the elevation selection lever 78. Further, the elevation selection lever 78 may include an indicator pin 78*a* extending away from the proximal end 72 and proximate the elevation scale 39. The elevation scale 39 may include numerical markings to aid a user in adjusting the elevation selection lever 78 and, as a result, adjusting the lower sight assembly 60.

Figure 4A:
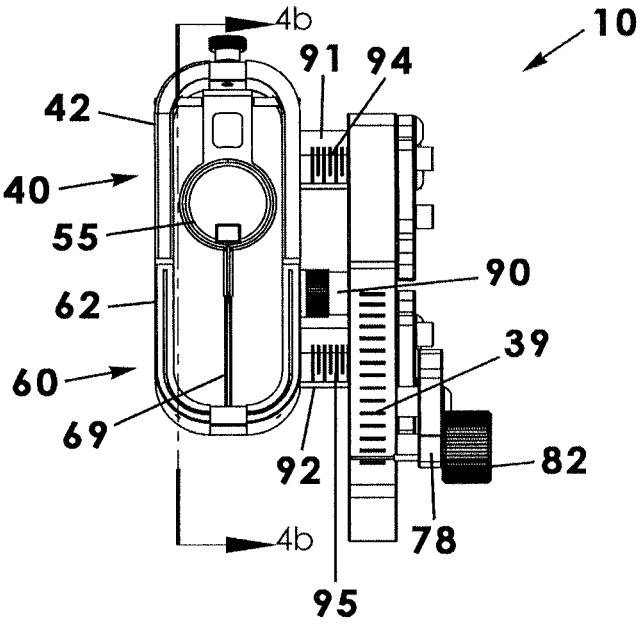
FIG. 4*a* is a front view of the bow sighting apparatus as in FIG. 3*a* illustrated in a forwardly tilted orientation.
Figure 4B:
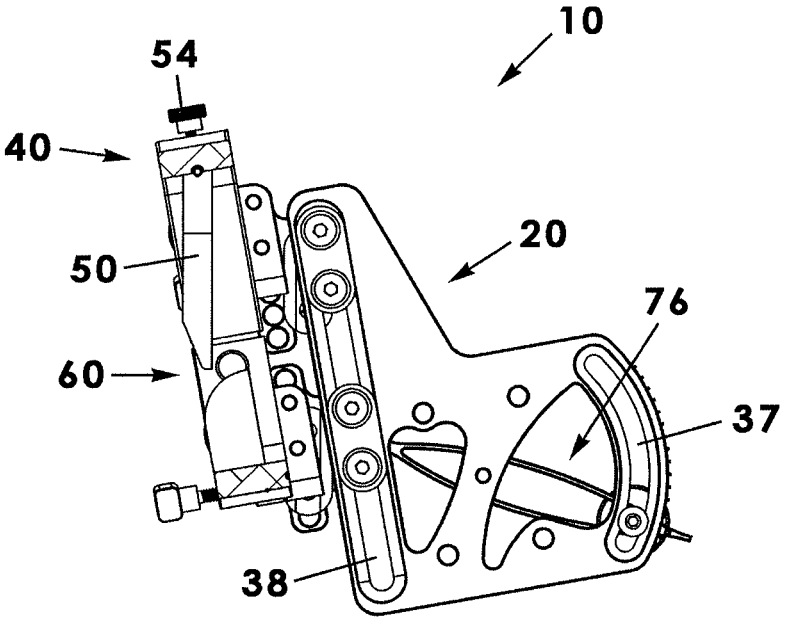
FIG. 4*b* is a side view of the bow sighting apparatus as in FIG. 4*a;*
Figure 5A:
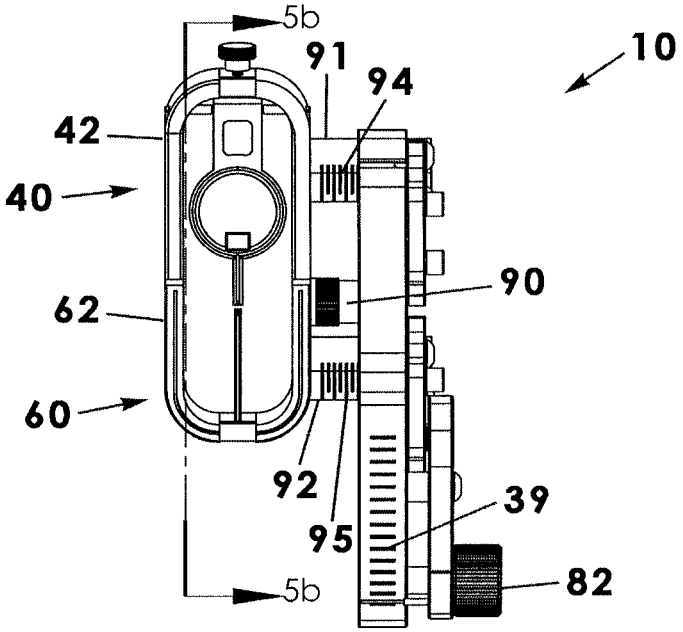
FIG. 5*a* is a front view of the bow sighting apparatus as in FIG. 3*a* illustrated in a forwardly tilted orientation.
Figure 5B:
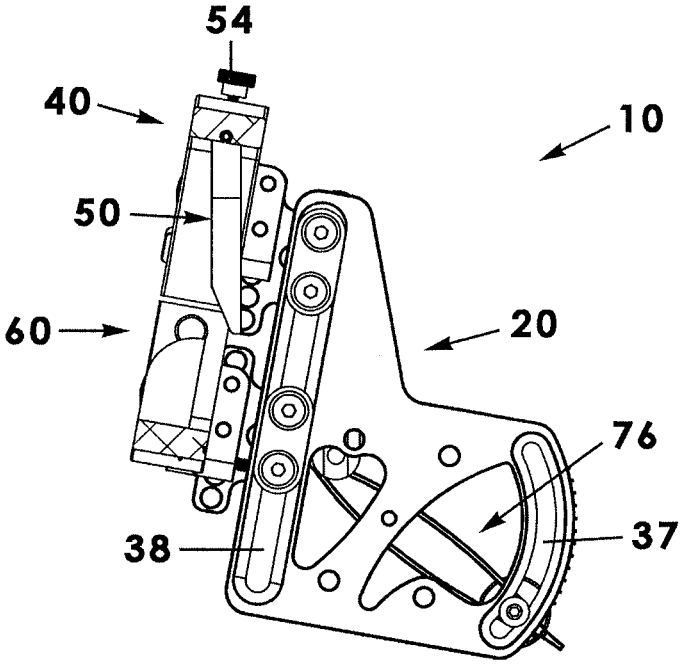
FIG. 5*b* is a side view of the bow sighting apparatus as in FIG. 5*a;*
Figure 6:
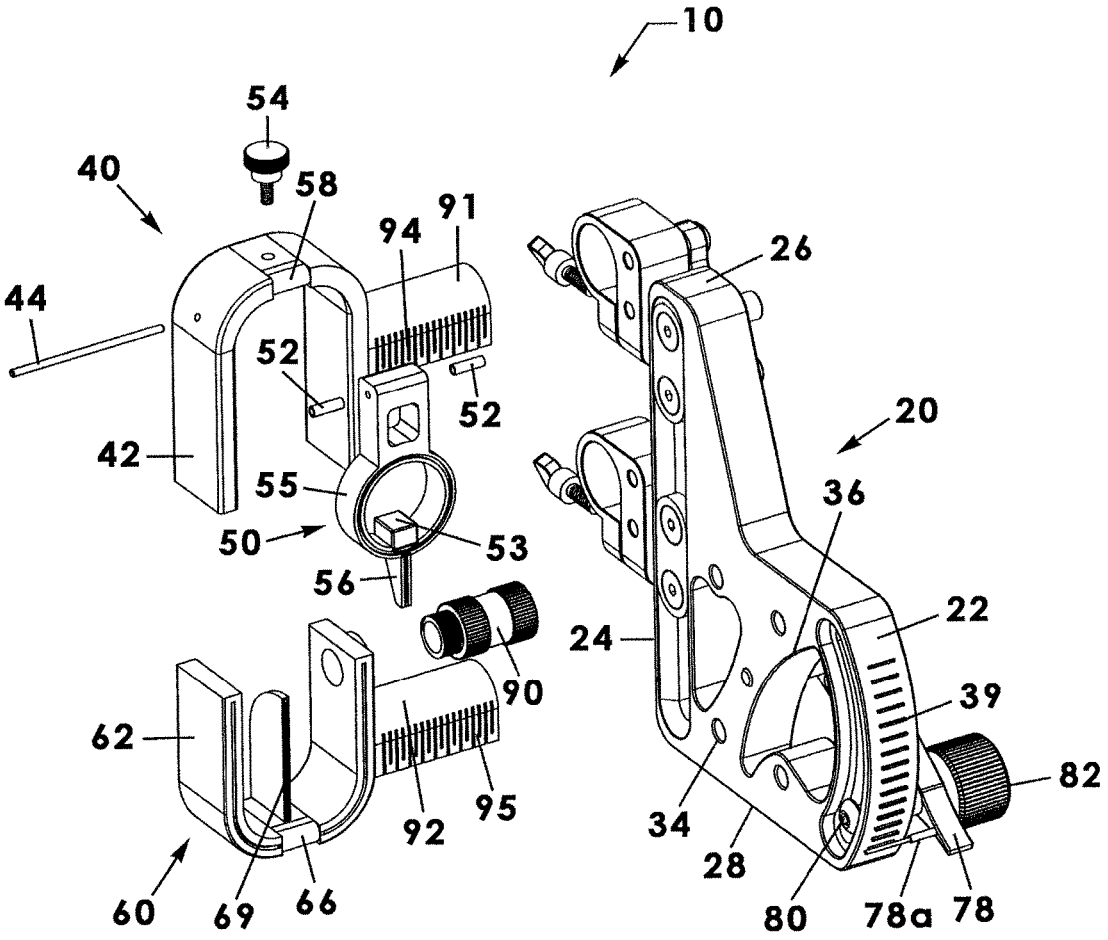
FIG. 6 is an exploded view of the bow sighting apparatus as in FIG. 1.

Now with further reference to the pendulum sight 50, the upper end 26 of the pendulum sight 50 is pivotally or rotatably mounted to the mounting rod 40 so that the pendulum sight 50 remains level even if the archery bow is tilted forwardly or rearwardly while aiming a shot, as illustrated in FIGS. 4*b* and 5*b*. In addition, a sleeve 52 may be mounted about the rod 44 so as to not allow the pendulum sight 50 to slide laterally along the mounting rod 44. And, a lock screw 54 may be in communication with the upper end 26 of the pendulum sight 50 so that, when tightened, the pendulum sight 50 cannot rotate at all. This is useful when the bow sighting apparatus 10 is being transported or mounted, i.e. to prevent damage thereto.

A fiber optic ring 55 is coupled to the upper end 26 of the pendulum sight 50 and extends downwardly therefrom. In an embodiment, the fiber optic ring 55 may include a glass, plastic, or otherwise transparent construction that is hollow and in which a fiber optic cable or other material capable of absorbing ambient light may be situated. Further, a fiber optic sight rod 56 extends downwardly away from the fiber optic ring 55, the free end of which (i.e. a fiber optic sight tip 57) acts as the sight tip a hunter positions on his target. It is understood that the fiber optic ring 55, sight rod 56, and sight tip 57 are configured to absorb ambient light and, as a result, to emit a glowing light for a period of time thereafter. In an embodiment, the upper frame section 42 itself may having a transparent configuration and include an embedded fiber optic element. The fiber optics of the upper sight assembly 40 are of a first color, such as a green color.

In addition, the pendulum sight 50 may include a weight 53 positioned adjacent the fiber optic ring 55, the weight causing gravity to always pull the pendulum sight 50 downwardly into a perfectly vertical position even if the mounting member 20 and upper and lower sight assemblies are tilted forwardly or rearwardly (FIGS. 4*b* and 5*b*). In addition, the upper frame section 42 of the upper sight assembly 40 may includes a horizontal upper spirit level 58 to enable a user to visually observe if he is holding the archery bow and, as a result, the bow sighting apparatus 10 in a horizontally level position during use. Similarly, the lower frame section 62 of the lower sight assembly 60 may includes a horizontal lower spirit level 66.

Similarly, the lower sight assembly 60 may include fiber optic components as well. More particularly, the lower frame section 62 may include a transparent construction and include a fiber optic element 68. Further, the vertical sight pin 69 may include a fiber optic construction capable of absorbing ambient light and, as a result, emitting a glow. In an embodiment, the fiber optics of the lower sight assembly 60 are of a second color, such as orange, different from the first color exhibited by the fiber optics of the upper sight assembly 40.

In another aspect, the bow sighting apparatus 10 includes a black light device 90 coupled to the mounting member 20 and situated to direct a black light in the direction of the fiber optic elements described above. More particularly, the black light device 90 is positioned to direct light at the fiber optic ring 55, sight rod 56, and sight tip 57. Likewise, the black light device 90 is positioned to direct light toward the vertical sight pin 69 of the lower sight assembly 60.

Preferably, the lower frame section 62 of the lower sight assembly 60 has a generally U-shaped configuration while the upper frame section 42 of the upper sight assembly 40 has a generally inverted U-shaped configuration although more gentle general convex and concave configurations or even rectangular configurations may also work.

In still another aspect, the lower frame section 62 is slidably movable laterally to selected configurations closer to the mounting member 20 or further away from the mounting member 20. Similarly, the upper frame section 42 is slidably movable laterally to selected configurations closer to the mounting member 20 or further away from the mounting member 20. Scale indicia 94, 95 may be imprinted on respective mounting arms 90, 92 to aid a user in appropriately making lateral sight adjustments. It is understood that rotational mounting and locking fasteners substantially similar to those described above relative to the elevation adjustment assembly 70 may be used to facilitate respective lateral adjustments.

In use, the dual bow sighting apparatus 10 may be sighted in prior to engaging in actual hunting. For instance, the bow sighting apparatus 10 may be mounted to a bow and shots with arrows may be taken toward a target. The elevation settings of the sight assemblies, lateral adjustments, and the like may be adjusted as described above. When ready to hunt, which may be before dawn, the black light device 90 may be energized to emit light to the fiber optic elements so they will glow when needed (in darkened conditions). It is understood that the lower sight assembly 60 must be adjusted to be immediately adjacent the upper sight assembly 40 in order for all the fiber optic elements to receive the black light. Once the sun comes up, of course, ambient light will be absorbed by the fiber optic elements.

Then, when hunting, the upper sight assembly 40 is already in a preset condition to be used accurately by a hunter for a shot of, say, 1 to 30 yards. But, if a target animal is, say, 30 to 50 yards away, the lower sight assembly 60 needs to be set and used. The elevation may be set by a user's operation of the elevation selection lever 78 and linkage 76 and by observing the elevation scale 39 as described above. Now, the hunter uses the tip of the vertical sight pin 69 of the lower sight assembly 60 to properly target the animal before firing an arrow.

It is understood that while certain forms of this invention have been illustrated and described, it is not limited thereto except insofar as such limitations are included in the following claims and allowable functional equivalents thereof.

The invention claimed is:

1. A dual bow sighting apparatus for use with an archery bow to sight in a target, comprising:

a mounting member configured for attachment to the archery bow, said mounting member defining an aperture proximate a rear end thereof having a dimension that enhances the grip of a user when mounting the mounting member to the archery bow;

an upper sight assembly coupled to an upper end of said mounting member at a predetermined vertical elevation associated with a first distance shot, said upper sight assembly having an upper frame section and a pendulum sight pivotally coupled to said upper frame section;

a lower sight assembly operatively coupled to a lower end of said mounting member and positioned at a vertically adjustable elevation relative to said upper sighting assembly and associated with a second distance shot of a longer distance than said first distance shot, said lower sight assembly having a lower frame section and a vertical sight pin extending upwardly from said lower frame section;

an elevation adjustment assembly coupled to said mounting member and having a linkage in communication with said lower sight assembly such that operation of said linkage by a user in real time while hunting changes a vertical distance between said upper and lower sight assemblies, respectively;

wherein said linkage includes an elevation selector lever at a proximal end configured for movement by a user and a distal end coupled to said lower frame section, said linkage having a linear configuration such that a vertical movement of said elevation selector lever causes an inverse vertical movement of said lower frame section;

wherein said upper sight assembly and said lower sight assembly define and share a single vertical plane throughout said vertical movement of said lower frame assembly;

wherein said upper sight assembly and said lower sight assembly are positioned in displaced horizontal planes such that only one of said upper sight assembly or said lower sight assembly is used to sight in the target.

2. The dual bow sighting apparatus as in claim 1, further comprising a locking assembly coupled to said elevation selection lever and to said mounting member, said locking assembly operable between an actuated configuration that prevents movement of said elevation selection lever and an unactuated configuration that allows movement of said elevation selection lever.

3. The dual bow sighting apparatus as in claim 2, wherein:

said mounting member defines a slot having a substantially vertical configuration adjacent a first end thereof;

said locking assembly includes:

said a first locking fastener coupled to said elevation selector lever and extending into said slot, said first locking fastener being movable along said slot when said elevation selector lever is moved by a user;

a second locking fastener coupled to said elevation selection lever opposite said first locking fastener and in operative communication therewith, said second locking fastener being rotationally movable between a tightened configuration preventing movement of said elevation selection lever and a loosened configuration allowing movement of said elevation selection lever.

4. The dual bow sighting apparatus as in claim 1, further comprising:

an elevation scale positioned on an outer surface of an end of said mounting member;

wherein said elevation selection lever includes an indicator pin extending away from said proximal end thereof and proximate said elevation scale.

5. The dual bow sighting apparatus as in claim 1, wherein said pendulum sight includes:

an upper end pivotally coupled to a mounting rod situated adjacent an upper end of said upper framework of said upper sight assembly;

a fiber optic ring coupled to said upper end;

an upper fiber optic sight rod extending downwardly from said fiber optic ring to a fiber optic sight tip;

wherein said fiber optic ring and said upper fiber optic sight rod are configured to absorb ambient light and, as a result, emit a glowing light.

6. The dual bow sighting apparatus as in claim 5, wherein said pendulum sight includes a weight positioned adjacent said fiber optic mounting ring and configured to cause said pendulum sight to pivot about said mounting rod and maintain a level position when said upper sight assembly is tilted forward or rearward.

7. The dual bow sighting apparatus as in claim 5, wherein said vertical sight pin of said lower sight assembly includes a fiber optic element and is configured to absorb ambient light and, as a result, to emit a glow.

8. The dual bow sighting apparatus as in claim 7, wherein said fiber optic ring and said fiber optic sight tip emit a first color and said fiber optic element of said vertical sight pin emits a second color different from said first color.

9. The dual bow sighting apparatus as in claim 7, further comprising a black light device coupled to said mounting member, wherein said black light device is positioned to selectively emit black light in a direction that impacts said fiber optic sight element of said vertical sight pin.

10. The dual bow sighting apparatus as in claim 7, further comprising a single black light mounted to said mounting member and positioned to selectively emit black light in a direction that simultaneously impacts said fiber optic sight elements of said upper sight assembly and said lower sight assembly when said lower sight assembly is immediately lowerly adjacent said upper sight assembly.

11. The dual bow sighting apparatus as in claim 5, further comprising a black light device coupled to said mounting member, wherein said black light device is positioned to selectively emit black light in a direction that impacts said fiber optic ring and said upper fiber optic sight rod.

12. The dual bow sighting apparatus as in claim 1, wherein said lower sight assembly is always lowerly and vertically separated from said upper sight assembly, said lower and upper sight assemblies being separated within said shared vertical plane by a distance according to an operation of said elevation adjustment assembly.

13. The dual bow sighting apparatus as in claim 1, wherein said linkage is pivotally coupled to said mounting member at a fulcrum defined about midway between said proximal and distal ends of said linkage so that a vertical movement of said elevation selector lever causes an inverse vertical movement of said lower frame section.

14. The dual bow sighting apparatus as in claim 1, wherein said upper frame section of said upper sight assembly includes a horizontal spirit level.

15. The dual bow sighting apparatus as in claim 1, wherein said lower sight assembly includes a horizontal spirit level.

16. The dual bow sighting apparatus as in claim 1, wherein said mounting member is situated perpendicular to said upper and lower sight assemblies.

17. The dual bow sighting apparatus as in claim 1, and positioned to selectively emit black light in a direction that impacts said pendulum sight and said vertical sight pin.

18. The dual bow sighting apparatus as in claim 1, wherein said lower frame section has a U-shaped configuration and said upper frame section has an inverted U-shaped configuration.

19. The dual bow sighting apparatus as in claim 1, wherein:

said upper frame section is selectively adjustable laterally between a position closer to or further away from said mounting member;

said lower frame section is selectively adjustable laterally between a position closer to or further away from said mounting member.

20. The dual bow sighting apparatus as in claim 1, wherein a lock fastener is in communication with an upper end of said pendulum sight for selectively preventing pivotal movement of said pendulum sight relative to said upper section of said upper sight assembly.

* * * * *